US011141744B2

(12) United States Patent
Curtis

(10) Patent No.: US 11,141,744 B2
(45) Date of Patent: Oct. 12, 2021

(54) SPRAY NOZZLE WITH FLOATING TURBINE

(71) Applicant: Harold D. Curtis Revocable Trust, Oklahoma City, OK (US)

(72) Inventor: Harold D. Curtis, Oklahoma City, OK (US)

(73) Assignee: Harold D. Curtis Revocable Trust, Oklahoma City, OK (US)

( * ) Notice: Subject to any disclaimer, the term of this patent is extended or adjusted under 35 U.S.C. 154(b) by 0 days.

(21) Appl. No.: 15/491,757

(22) Filed: Apr. 19, 2017

(65) Prior Publication Data

US 2017/0297043 A1 Oct. 19, 2017

Related U.S. Application Data

(60) Provisional application No. 62/324,544, filed on Apr. 19, 2016.

(51) Int. Cl.

| | |
|---|---|
| ***B05B 3/04*** | (2006.01) |
| ***F28F 25/06*** | (2006.01) |
| ***B05B 1/26*** | (2006.01) |
| ***B05B 15/18*** | (2018.01) |

(52) U.S. Cl.

CPC ..... *B05B 3/0427* (2013.01); *B05B 1/26* (2013.01); *B05B 15/18* (2018.02); *F28F 25/06* (2013.01)

(58) Field of Classification Search

CPC ..... B05B 3/0427; B05B 3/0431
USPC ..... 239/240
See application file for complete search history.

(56) References Cited

U.S. PATENT DOCUMENTS

| | | | | |
|---|---|---|---|---|
| 2,555,271 A | | 5/1951 | Jauch et al. | |
| 3,756,515 A | | 9/1973 | Arnold | |
| 4,081,138 A | | 3/1978 | Behr | |
| 4,101,075 A | * | 7/1978 | Heitzman | B05B 3/04 239/101 |
| 4,111,366 A | | 9/1978 | DeWitte | |
| 4,204,646 A | * | 5/1980 | Shames | B05B 1/1609 239/381 |
| 4,324,364 A | * | 4/1982 | Buzzi | B05B 1/1627 239/381 |
| 4,337,216 A | | 6/1982 | Korsell | |
| 4,579,284 A | * | 4/1986 | Arnold | B05B 3/04 239/381 |
| 4,703,893 A | * | 11/1987 | Gruber | B05B 1/1618 239/391 |

(Continued)

OTHER PUBLICATIONS

International Search Report and Written Opinion (PCT/US2008/084889); dated Jan. 29, 2009.

(Continued)

*Primary Examiner* — Chee-Chong Lee
(74) *Attorney, Agent, or Firm* — Dunlap Codding, P.C.

(57) ABSTRACT

A spray nozzle that includes a nozzle body defining a first surface, a cap defining a second surface able to define an annular nozzle opening therebetween, a turbine having a plurality of radially extending fins circumferentially positioned about the nozzle opening for directing the flow of fluid exiting the nozzle opening, and a reverser member including a cup portion positioned below the cap to intercept the flow of fluid from a flow passage of the cap. The reverser member coupled to the turbine such that the reverser member is caused to rotate in response to rotation of the turbine.

11 Claims, 6 Drawing Sheets

(56) References Cited

U.S. PATENT DOCUMENTS

| | | | | |
|---|---|---|---|---|
| 4,754,928 | A * | 7/1988 | Rogers | B05B 1/1645 239/381 |
| 5,152,458 | A | 10/1992 | Curtis | |
| 5,170,946 | A | 12/1992 | Rankin | |
| 5,180,103 | A | 1/1993 | Harrison, Jr. et al. | |
| 5,545,356 | A | 8/1996 | Curtis et al. | |
| 5,569,415 | A | 10/1996 | Phelps | |
| 5,704,825 | A | 1/1998 | LeCompte | |
| 5,810,263 | A | 9/1998 | Tramm | |
| 5,833,143 | A | 11/1998 | Hsin-Fa | |
| 5,839,667 | A | 11/1998 | Fishcer | |
| 6,070,860 | A | 6/2000 | Kinney, Jr. et al. | |
| 6,082,639 | A | 7/2000 | Pentz et al. | |
| 6,164,566 | A | 12/2000 | Hui-Chen | |
| 6,293,857 | B1 | 9/2001 | Allard | |
| 6,598,810 | B2 | 7/2003 | Lanteri | |
| 6,675,581 | B1 | 1/2004 | Stuttaford et al. | |
| 6,715,404 | B2 | 4/2004 | Pratt | |
| 6,715,699 | B1 | 4/2004 | Greenberg et al. | |
| 6,905,082 | B1 | 6/2005 | Wu | |
| 6,991,192 | B2 | 1/2006 | Phillips et al. | |
| 7,261,248 | B2 | 8/2007 | Curtis | |
| 2003/0145619 | A1 | 8/2003 | Word | |
| 2004/0080060 | A1 | 4/2004 | Mockry et al. | |
| 2004/0195359 | A1 | 10/2004 | Curtis | |
| 2006/0038046 | A1 * | 2/2006 | Curtis | B05B 3/0486 241/38 |
| 2010/0230513 | A1 | 9/2010 | Curtis | |

OTHER PUBLICATIONS

International Preliminary Report on Patentability (PCT/US2008/084889); dated Jun. 10, 2010.

* cited by examiner

SPRAY NOZZLE WITH FLOATING TURBINE

CROSS-REFERENCE TO RELATED APPLICATION

This application claims priority to U.S. Provisional Application Ser. No. 62/324,544, filed on Apr. 19, 2016, the entire contents of which being hereby expressly incorporated herein by reference.

BACKGROUND

Cooling towers typically utilize a grid work of overhead nozzles to form a plurality of overlapping spray patterns for the purpose of distributing water over the upper surface of a layer of fill material through which air is drawn. The water flows downward through the fill material as the air flows upward through or across the fill material whereby the heat of the water is transferred to the air.

It is important to obtain as uniform a distribution as possible of the water over the upper surface of the fill material so that the water will uniformly flow through the fill material across the entire cross-sectional area of the tower. If the water distribution is not uniform, channels of uneven water loading will develop which cause the formation of low pressure paths through which the air will channel, thus greatly reducing the efficiency of the heat exchange operation conducted by the cooling tower.

It has been found that the efficiency of the heat exchange operation is greatly increased by using fluid distributing devices or nozzles that will create a plurality of abutting or overlapping square spray patterns, such as that disclosed in U.S. Pat. No. 5,152,458, the entire contents of which are hereby incorporated herein by reference. The formation of square spray patterns enables the spray patterns to be mated with each other so that voids or gaps do not exist between adjacent spray patterns. However, inefficiencies may still occur if the fluid distributed by each nozzle is not distributed uniformly across each of the individual square spray patterns.

The nozzles typically include a nozzle body, a cap, and a turbine. The nozzle body is provided with a central hub fixed within a fluid passage of the nozzle body with a plurality of radially spaced ribs. The cap has a stem with a central bore. The stem is configured to be slidingly registered in the central hub of the nozzle body. The cap is connected to the nozzle body so that the nozzle body and the cap are spaced apart from one another to define an annular nozzle opening therebetween.

The turbine has a mounting ring sized to be positioned about the nozzle body and a plurality of fins extending circumferentially about a bottom surface of the nozzle body. The fins extend radially outward from the bottom surface of the mounting ring so that the fins are positioned to intercept the fluid exiting the nozzle opening and uniformly distribute the water. The mounting ring is held in place by a locking ring so that the turbine is freely rotatable relative to the nozzle body and the cap. The mounting ring of the turbine is generally flat so that a portion of the fluid exiting the nozzle opening flows across the bottom of the mounting ring. The flow of fluid across the mounting ring in this manner creates a fluid bearing on which the turbine rotates.

While such nozzles have met with success, drawbacks nevertheless are encountered. In particular, such cooling tower nozzles are subject to failure as a result of the mounting ring contacting the locking ring. The contact creates a wear point.

To this end, a need exists for a spray nozzle which overcomes the problems of the prior art. It is to such a spray nozzle that the inventive concepts disclosed herein are directed.

DETAILED DESCRIPTION OF EXEMPLARY EMBODIMENTS

Figure 1:
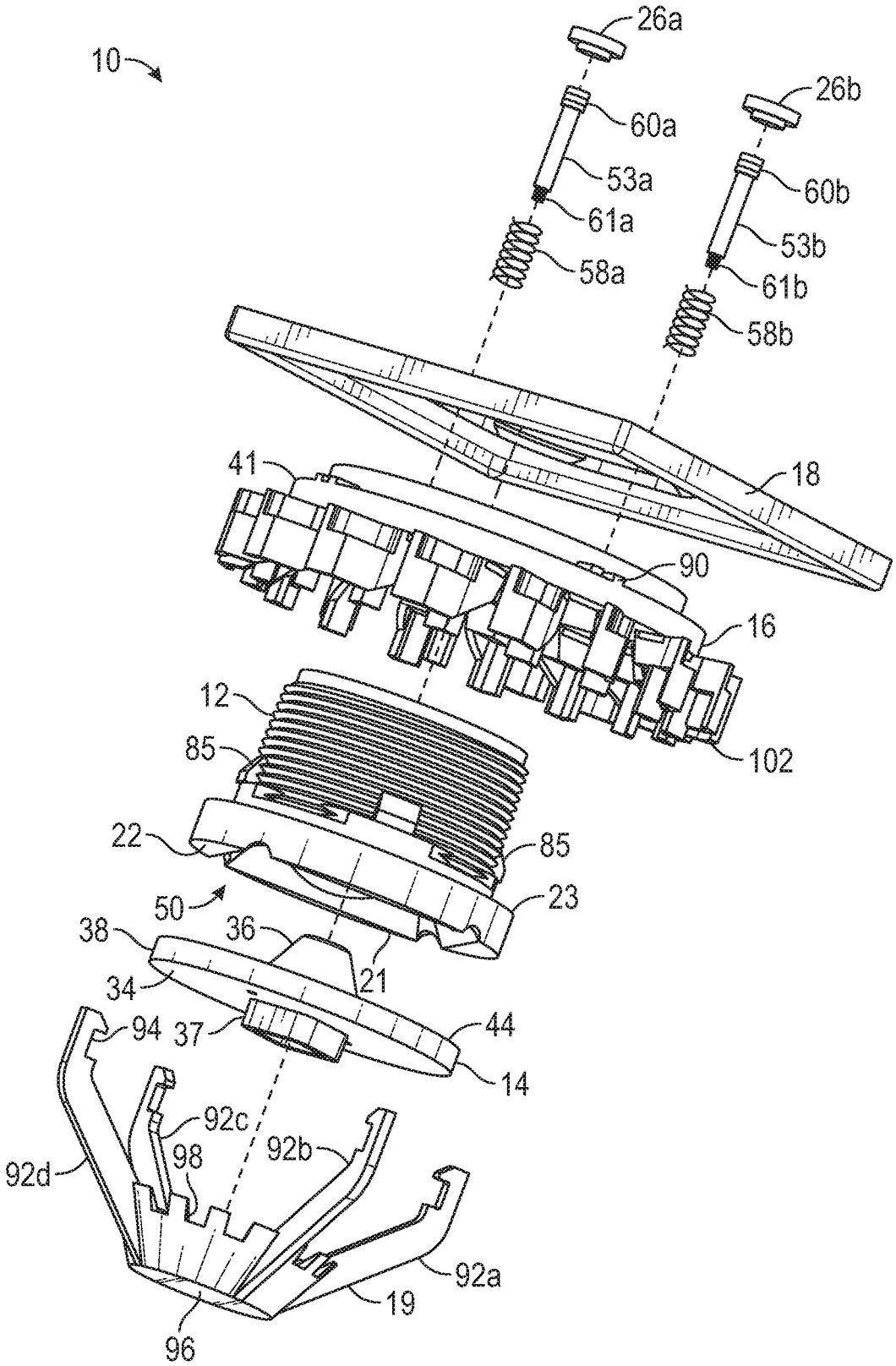
FIG. 1 is an exploded, perspective view of a spray nozzle constructed in accordance with the inventive concepts disclosed herein.

Before explaining at least one embodiment of the disclosure in detail, it is to be understood that the disclosure is not limited in its application to the details of construction, experiments, exemplary data, and/or the arrangement of the components set forth in the following description or illustrated in the drawings unless otherwise noted.

The systems and methods as described in the present disclosure are capable of other embodiments or of being practiced or carried out in various ways. Also, it is to be understood that the phraseology and terminology employed herein are for purposes of description, and should not be regarded as limiting.

The following detailed description refers to the accompanying drawings. The same reference numbers in different drawings may identify the same or similar elements.

As used in the description herein, the terms "comprises," "comprising," "includes," "including," "has," "having," or any other variations thereof, are intended to cover a non-exclusive inclusion. For example, unless otherwise noted, a process, method, article, or apparatus that comprises a list of elements is not necessarily limited to only those elements, but may also include other elements not expressly listed or inherent to such process, method, article, or apparatus.

Further, unless expressly stated to the contrary, "or" refers to an inclusive and not to an exclusive "or." For example, a condition A or B is satisfied by one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or more, and the singular also includes the plural unless it is obvious that it is meant otherwise. Further, use of the term "plurality" is meant to convey "more than one" unless expressly stated to the contrary.

As used herein, any reference to "one embodiment," "an embodiment," "some embodiments," "one example," "for example," or "an example" means that a particular element, feature, structure or characteristic described in connection with the embodiment is included in at least one embodiment. The appearance of the phrase "in some embodiments" or "one example" in various places in the specification is not necessarily all referring to the same embodiment, for example.

Figure 2:
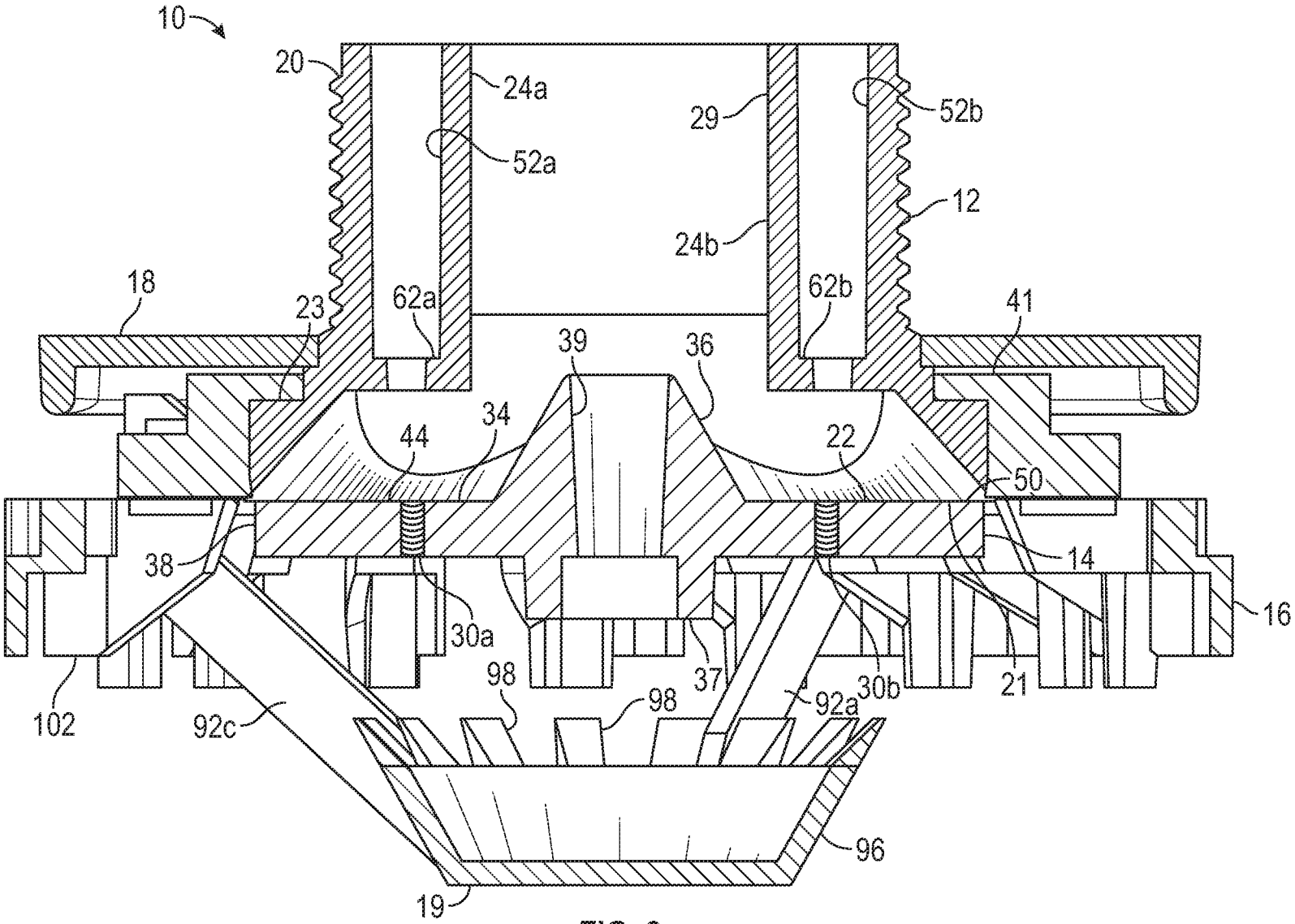
FIG. 2 is a sectional view of the spray nozzle of FIG. 1 shown with a pair of fasteners removed.

Referring now to FIGS. 1-2, shown therein is one embodiment of a spray nozzle 10 constructed in accordance with the inventive concepts disclosed herein. The spray nozzle 10 includes a nozzle body 12, a cap 14, a turbine 16, a retaining member 18, and a reverser member 19.

The nozzle body 12 is a generally tubular member defining a fluid passage 29 (FIG. 2). The nozzle body 12 has a threaded inlet end 20 for connecting the nozzle body 12 to a fluid distributing header (not shown) and an outlet end 21 provided with a flange 23 having an irregular shaped annular surface 22.

The irregular shaped annular surface 22 is an undulating surface having four peaks 25*a*-25*d* (FIG. 3) equally spaced at 90 degree intervals about the circumference of the annular surface 22 and four troughs 27*a*-27*d* (FIG. 3) located between the peaks 25*a*-25*d* and also being substantially equally spaced. One of the troughs 27*a*-27*d* is located equidistant between each adjacent pair of peaks 25*a*-25*d*.

The nozzle body 12 is further provided with peg portions 24*a* and 24*b*. The peg portions 24*a* and 24*b* are diametrically formed on the circumference of the fluid passage 29 of the nozzle body 12. While two peg portions are illustrated, it will be appreciated that any number of peg portions may be employed. The peg portions 24*a* and 24*b* are provided with a longitudinal bore 52*a* and 52*b* extending through the peg portions 24*a* and 24*b*. The bores 52*a* and 52*b* include shoulders 62*a* and 62*b* at a distal end thereof. Compression springs 58*a* and 58*b* (FIG. 1) are positioned in the longitudinal bore 52*a* and 52*b* and secured therein with fasteners 53*a* and 53*b*. The fasteners 53*a* and 53*b* are slidably disposed through the compression springs 58*a* and 58*b*, extend from the distal end of the longitudinal bore 52*a* and 52*b*, and are connected to the cap 14 via threaded openings 30*a* and 30*b*. The fasteners 53*a* and 53*b* may be shoulder bolts formed of an appropriate material, such as stainless steel, to resist corrosion. The fasteners 53*a* and 53*b* have heads 60*a* and 60*b* which cooperate with the shoulders 62*a* and 62*b* to retain the compression springs 58*a* and 58*b*. The longitudinal bores 52*a* and 52*b* may be filled with a lubricant (not shown) and sealed with caps 26*a* and 26*b*.

Figure 5:
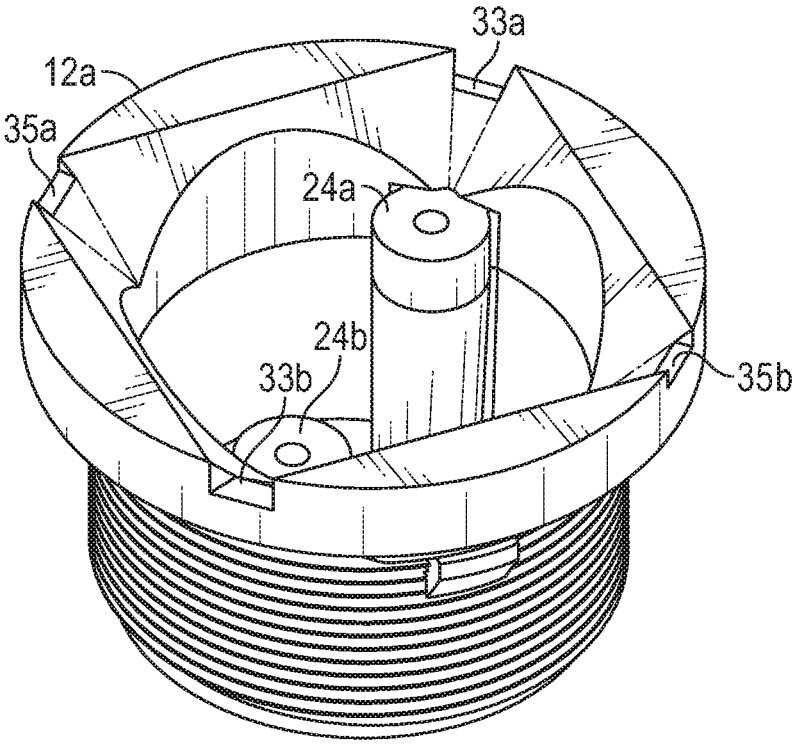
FIG. 5 is a bottom perspective view of another embodiment of a nozzle body.

FIG. 5 illustrates another embodiment of a nozzle body 12*a*. The nozzle body 12*a* is similar to the nozzle body 12 except the nozzle body 12*a* has troughs 33*a* and 33*b* and troughs 35*a* and 35*b*. Each of the troughs 33*a*, 33*b*, 35*a*, and 35*b* has a rectangular shape rather than a semi-oval shape as shown for the troughs 27*a*-27*d*. In addition, the troughs 33*a* and 33*b*, which are positioned adjacent to the peg portions 24*a* and 24*b*, respectively, are formed to have a flow area greater than the flow area of the troughs 35*a* and 35*b*. In one embodiment, the flow area of the troughs 33*a* and 33*b* is increased relative to the flow area of the troughs 35*a* and 35*b* by forming the troughs 33*a* and 33*b* to have a width greater than the width of the troughs 35*a* and 35*b*.

Figure 6:
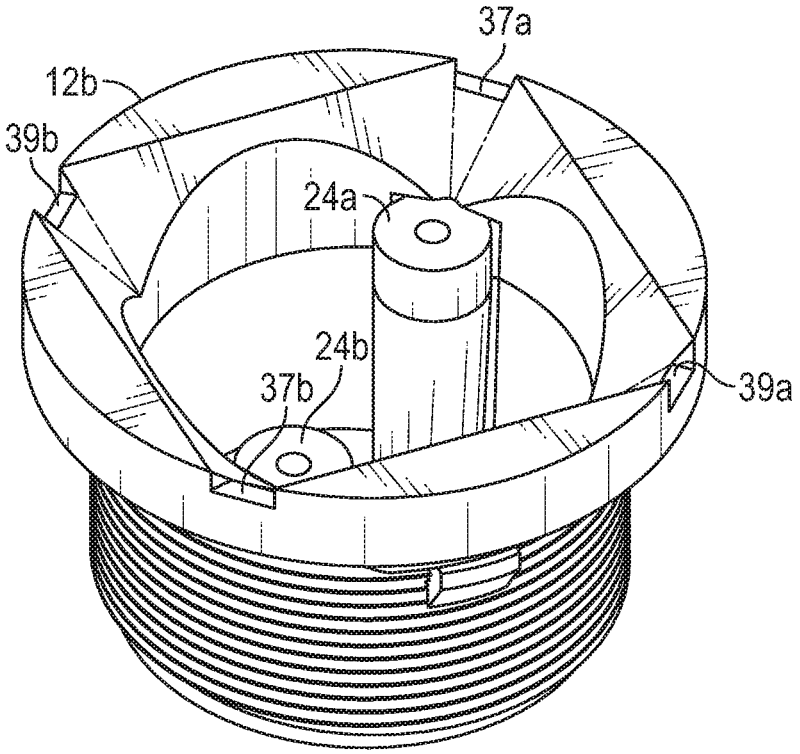
FIG. 6 is a bottom perspective view of another embodiment of a nozzle body.

FIG. 6 illustrates another embodiment of a nozzle body 12*b*. The nozzle body 12*b* is similar to the nozzle body 12*a* except the nozzle body 12*b* has troughs 37*a* and 37*b* and troughs 39*a* and 39*b*. Each of the troughs 37*a*, 37*b*, 39*a*, and 39*b* has a rectangular shape rather than a semi-oval shape as shown for the troughs 27*a*-27*d*. In addition, the troughs 37*a* and 37*b*, which are positioned adjacent to the peg portions 24*a* and 24*b*, respectively, are formed to have a flow area less than the flow area of the troughs 39*a* and 39*b*. In one embodiment, the flow area of the troughs 37*a* and 37*b* is decreased relative to the flow area of the troughs 39*a* and 39*b* by forming the troughs 37*a* and 37*b* to have a width less than the width of the troughs 39*a* and 39*b*.

Figure 7:
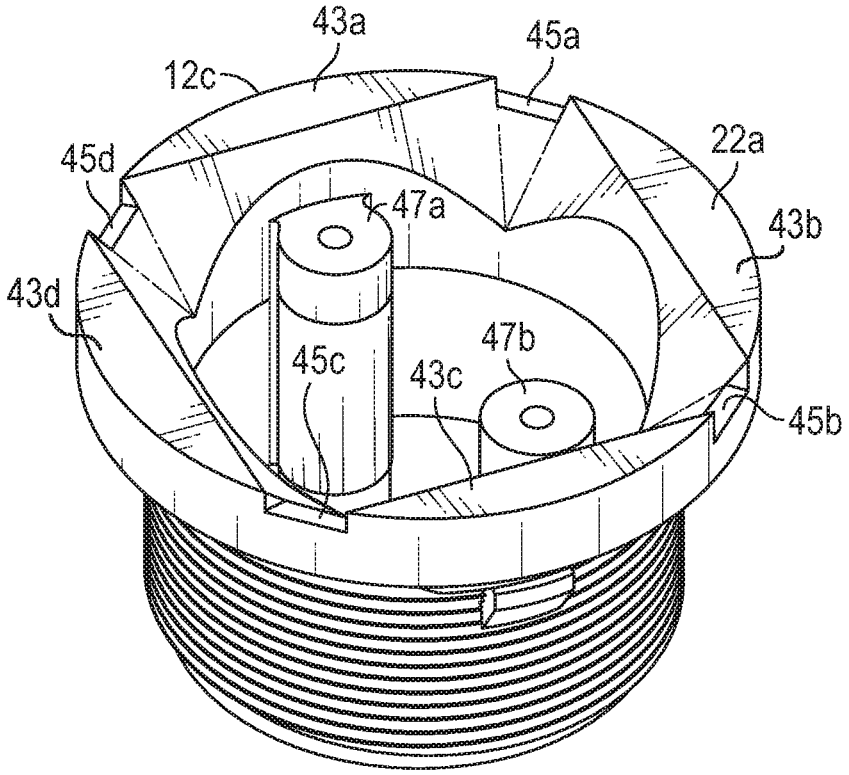
FIG. 7 is a bottom perspective view of another embodiment of a nozzle body.

FIG. 7 illustrates yet another embodiment of a nozzle body 12*c*. The nozzle body 12*c* is similar to the nozzle body 12 except the nozzle body 12*c* has an irregular shaped annular surface 22*a* that is an undulating surface having four peaks 43*a*-43*d* equally spaced at 90 degree intervals about the circumference of annular surface 22*a* and four troughs 45*a*-45*d* located between the peaks 43*a*-43*d* and also being substantially equally spaced. One of the troughs 45*a*-45*d* is located equidistant between each adjacent pair of peaks 43*a*-43*d*. Each of the troughs 45*a*-45*d* is shown to have a rectangular shape rather than a semi-oval shape as shown for the troughs 27*a*-27*d*.

The nozzle body 12*c* is provided with peg portions 47*a* and 47*b*, which are similar to the peg portions 24*a* and 24*b* described herein, except the peg portions 47*a* and 47*b* are positioned adjacent the peaks 43*a* and 43*c* rather than being positioned adjacent the troughs. In addition, the peaks 43*a* and 43*c*, which are positioned adjacent the peg portions 47*a* and 47*b*, respectively, are formed to have a surface area less than the surface area of the peaks 43*b* and 43*d*.

Returning to FIGS. 1-2, the cap 14 has a disk portion 34, a conical portion 36, and a square portion 37. A fluid flow passage 39 passes through the disk portion 34 via the conical portion 36 and the square portion 37. The conical portion 36 extends from the disk portion 34 a distance sufficient to prevent debris from clogging the fluid flow passage 39.

The disk portion 34 of the cap 14 has a rim 38 that defines an annular surface 44 which has a substantially planar configuration. The peg portions 24*a* and 24*b* are aligned with threaded openings 30*a* and 30*b* in the cap 14 such that the fasteners 53*a* and 53*b* may threadingly connect the nozzle body 12 to the cap 14. In one version, the threaded openings 30*a* and 30*b* are defined by a metal fixture embedded in the disk portion 34 of the cap 14. The cap 14 is connected to the nozzle body 12 so that the annular surface 22 of the nozzle body 12 and the annular surface 44 of the cap 14 define a nozzle opening 50 therebetween. More specifically, the cap 14 is connected to the nozzle body 12 so that a portion of the annular surface 22 of the nozzle body 12 and the annular surface 44 of the cap 14 are engaged when the spray nozzle 10 is in an un-pressurized condition. However, when pressurized, the annular surface 22 of the nozzle body 12 and the annular surface 44 of the cap 14 become spaced apart from another. The advantage of this feature will be described below.

Because of the irregular shape of the surface 22, the spacing between the surface 22 and the surface 44 varies around a circumference of the annular nozzle opening 50 to create a non-circular spray pattern of fluid exiting the nozzle opening 50. In particular, a generally square spray pattern will be provided due to the formation of four troughs 27*a*-27*d* and four peaks 25*a*-25*d*. The fluid flowing past the peaks 25*a*-25*d* will define the corners of the square pattern because the peaks 25*a*-25*d* cause a flow restriction which increases the pressure of the fluid and thus causes the fluid to flow farther than the fluid flowing past the troughs 27*a*-27*d*. While the troughs 25*a*-25*d* have been illustrated as being semi-oval in shape and the other troughs described herein have been illustrated as being rectangular in shape, the troughs may be formed to have a variety of other shapes, including square, triangular, and semi-circular, by way of example.

The biased connection of the cap 14 to the nozzle body 12 created in part by the compression springs 58*a* and 58*b* provides an automatic adjusting mechanism for increasing the spacing between the first and second annular surfaces 22 and 44 in response to an increase in fluid pressure in the annular nozzle opening 50. When fluid pressure supplied to the spray nozzle 10 is increased, the increased force acting on the cap 14 will compress the springs 58*a* and 58*b* to increase the spacing between annular surfaces 22 and 44. By causing the first and second annular surfaces 22 and 44 of the spray nozzle 10 to engage in a non-pressurized condition, the need to maintain tight tolerances with respect to the minimum spacing between the annular surfaces 22 and 44 is eliminated. Instead, the reaction of the cap 14 to fluid pressure is dependent on the tension of the compression springs 58*a* and 58*b*.

It will be appreciated that in the absence of the variable or automatic nozzle adjustment provided by the springs 58*a* and 58*b* and the sliding engagement of cap 14 with the nozzle body 12, a substantial increase in fluid supply pressure would cause the spray pattern to be extended radially outward to an undue extent and would tend to create a void in the center of the pattern. Conversely, a decrease in flow supply pressure would cause the spray pattern to be reduced radially inward and would tend to create a void in the outer perimeter of the spray pattern. By appropriate choice of the spring rate of the springs 58*a* and 58*b*, the spray nozzle 10 will automatically adjust the cross-sectional area of the annular nozzle opening 50 so as to maintain a substantially uniform spray pattern over a wide range of fluid supply pressures and flow rates.

Figure 3:
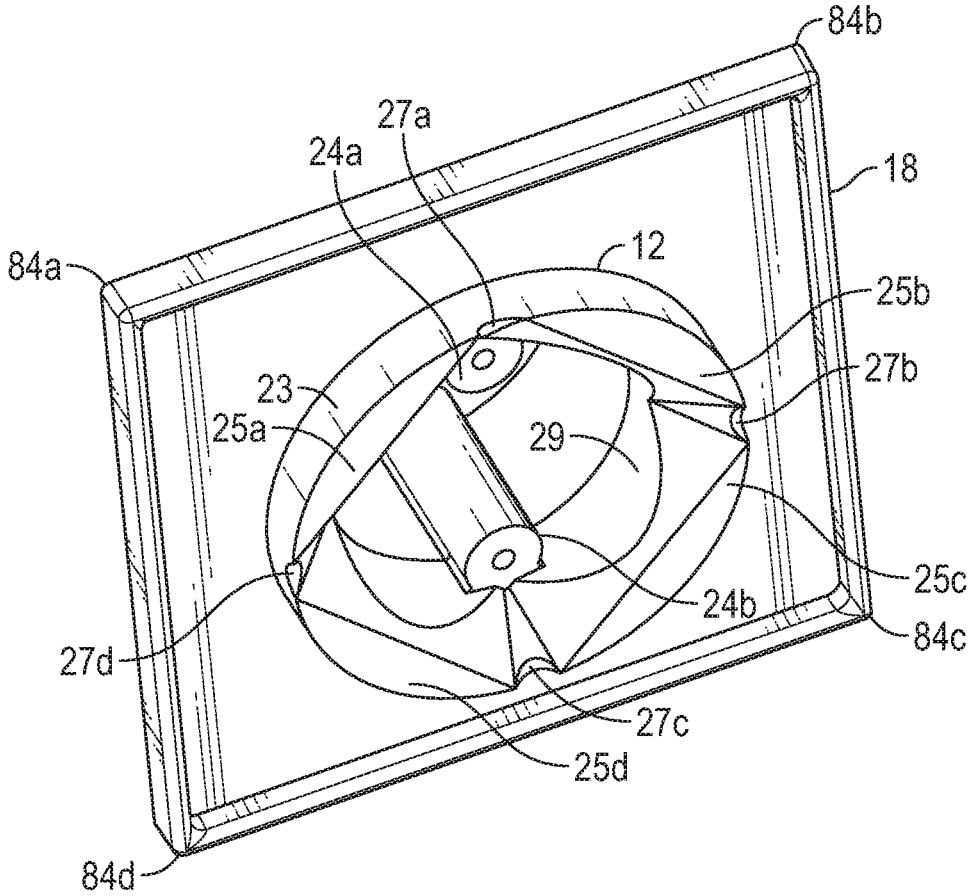
FIG. 3 is a bottom perspective view of a nozzle body and a retaining member of the spray nozzle.
Figure 4:
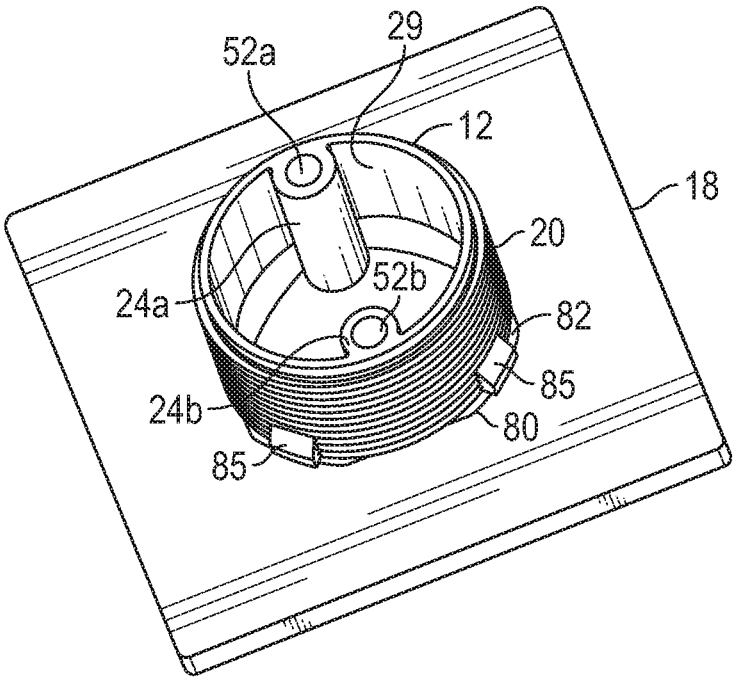
FIG. 4 is a top perspective view of the nozzle body and the retaining member of FIG. 3.

Referring now to FIGS. 3 and 4, shown therein is the retaining member 18 connected to the nozzle body 12. The retaining member 18 is provided with at least one keyway 80 which aligns with at least one key 82 on the nozzle body 12 to substantially align four corners 84*a*-84*d* of the retaining member 18 with the four peaks 25*a*-25*d* of the nozzle body 12. In such an embodiment, the retaining member 18 is a representation of a spray pattern of the spray nozzle 10 thus allowing the spray pattern to be visualized as the spray nozzle 10 is attached to the fluid distributing header thus allowing easier alignment of the spray nozzle 10. The nozzle body 12 is provided with a plurality of retaining tabs 85 that are configured to slidingly receive and retain the retaining member 18.

In one embodiment of the spray nozzle 10, the retaining member 18 is sized to extend over a substantial portion of the turbine 16 so as to prevent at least some drift droplets (sometimes referred to as drift emissions) from rising above the spray nozzle 10. Drift droplets that may have been caught in an airstream and carried out of the cooling tower will instead contact the underside of the retaining member 18 and eventually drop through the cooling tower as desired. In this way, unwanted emissions from the cooling tower may be reduced.

The connection between the retaining member 18 and the nozzle body 12 may facilitate the connection of the spray nozzle 10 to the fluid distributing header. For instance, in one embodiment, a service technician may grasp the retaining member 18 to rotate the spray nozzle 10 to threadingly connect the spray nozzle 10 to the fluid distributing header. In one embodiment of the spray nozzle 10, a connection tool (not shown) may be provided having two parallel sides and a gap in between. The connection tool may be used to fasten the spray nozzle 10 to the fluid distributing header. In such an embodiment, the gap of the connection tool is configured to receive the retaining member 18. Because of the connection between the retaining member 18 and the nozzle body 12, rotation of the retaining member 18 with the connection tool rotates the nozzle body 12 facilitating the threading connection of the nozzle body 12 to the fluid distributing header, for instance.

In one embodiment, the nozzle body 12, the cap 14, and the retaining member 18 may be constructed of a durable polymeric material, such as acetyl.

Referring again to FIGS. 1 and 2, the turbine 16 includes a mounting ring 41 sized to be positioned about the nozzle body 12, yet engageable with the flange 23 of the nozzle body 12 so that the turbine 16 is rotatable about the nozzle body 12 and a plurality of fins 102 extending circumferentially about a bottom surface of the mounting ring 41. More particularly, the turbine 16 may be constructed in accordance with the turbines disclosed in U.S. Pat. No. 7,261,248, which is hereby incorporated herein in its entirety by reference.

The reverser member 19 includes a cup portion 96 and a plurality of arms 92*a*-92*d* extending radially outward and upward from the cup portion 96. A rim of the cup portion 96 may be provided with notches 98 for diffusing fluid. The arms 92*a*-92*d* of the reverser member 19 are provided with clip portions 94 (only one of which is numbered in FIG. 1) configured to clip onto the turbine 16. The turbine 16 is provided with adapters 90 (only one of which is numbered in FIG. 1) configured to accept the clip portions of the arms 92*a*-92*d* of the reverser member 19. With the arms 92*a*-92*d* attached to the turbine 16, the cup portion 96 is positioned below the cap 14 in a spaced relationship thereto and substantially aligned with the fluid flow passage 39 of the cap 14 such that fluid passing through the fluid flow passage 39 of the cap 14 is directed into the cup portion 96 and the reverser member 19 is caused to rotate in response to rotation of the turbine 16.

Figure 8:
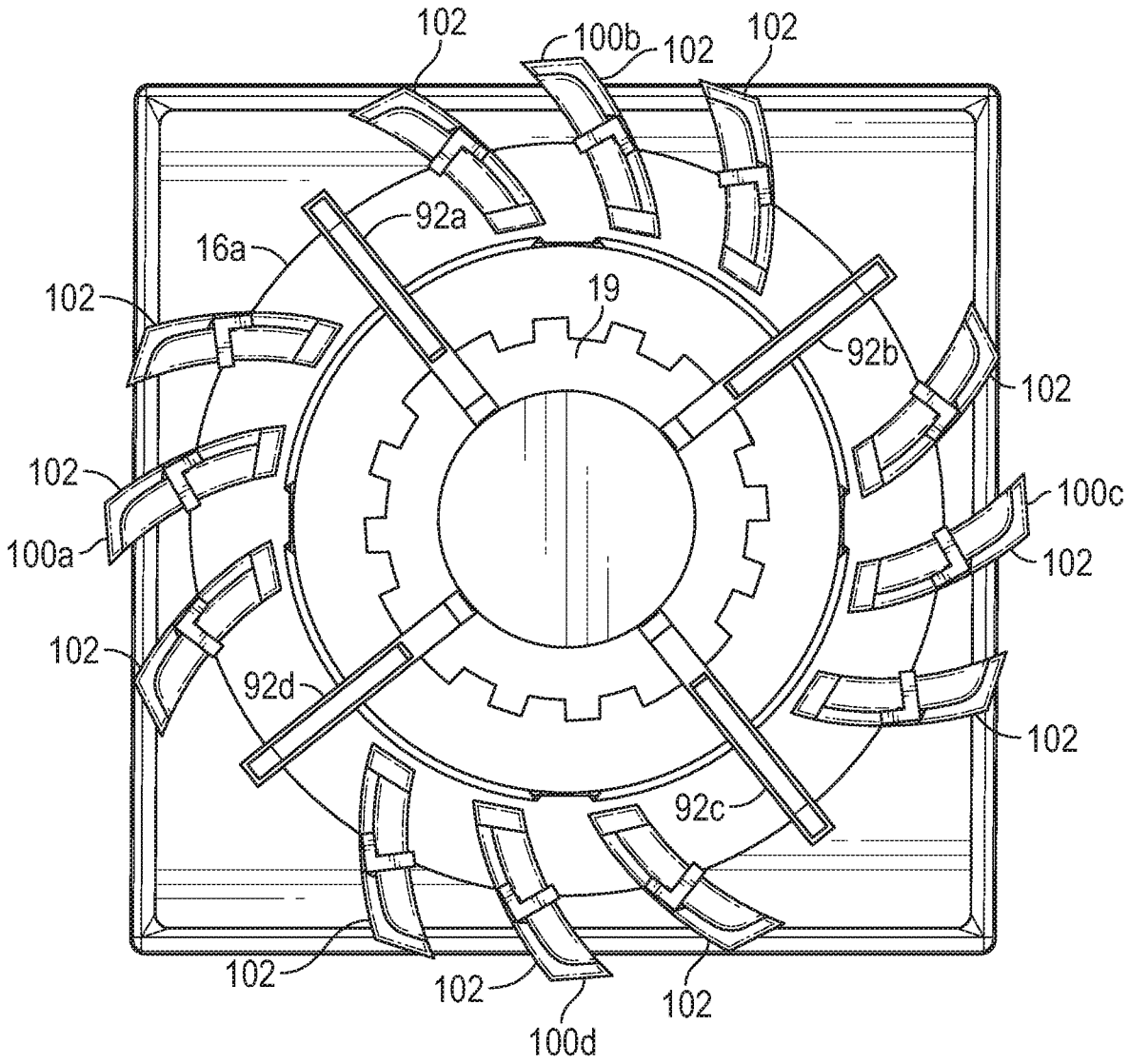
FIG. 8 is a bottom plan view of a reverser member of FIG. 1 shown connected to another embodiment of a turbine.

FIG. 8 shows another embodiment of a turbine 16*a* that is similar in construction to the turbine 16, except the turbine 16*a* is constructed to have a plurality of groups of fins 100*a*-100*d*. Each group of fins 100*a*-100*d* may contain any number and shape of fins 102 and the fins 102 may be equally spaced from one another. The groups of fins 100*a*-100*d* are spaced apart from one another a distance greater than the distance between adjacent fins 102 of each group of fins 100*a*-100*d*. In connecting the reverser member 19 to the turbine 16*a*, the arms 92*a*-92*d* may be positioned between the groups of fins 100*a*-100*d* in a way that the arms 92*a*-92*d* are non-radially aligned with the fins 102 of the turbine 16*a*, thereby not interfering with the distribution of water being deflected from the fins 102.

In operation, a portion of the fluid flowing through the spray nozzle 10 flows through the fluid flow passage 39 of the cap 14 and contacts the inside of the cup portion 96 causing a downward force on the turbine 16. The fluid flow passage 39 is sized such that the downward force applied to the cup portion 96, and thus the turbine 16, balances the upward force created by the fluid exiting the nozzle opening 50 to cause the turbine 16 to remain spaced from the cap 14 and the retaining member 18. In this way, a cushion of water forms between the turbine 16 and the retaining member 18 to reduce the rate of wear as the turbine 16 rotates.

From the above description, it is clear that the inventive concepts disclosed herein are well adapted to carry out the objects and to attain the advantages mentioned herein as well as those inherent in the inventive concepts disclosed herein. While presently preferred embodiments of the inventive concepts disclosed herein have been described for purposes of this disclosure, it will be understood that numerous changes may be made which will readily suggest themselves to those skilled in the art and which are accomplished within the scope and coverage of the inventive concepts disclosed and claimed herein.

What is claimed is:

1. A spray nozzle, comprising:

a nozzle body defining a first surface and a fluid passage;

a cap defining a second surface, the cap connected to the nozzle body such that the first surface of the nozzle body and the second surface of the cap form an annular nozzle opening therebetween, the cap biased toward the nozzle body to allow the spacing between the first surface and the second surface to increase in response to an increase in fluid pressure in the nozzle opening, the cap having a flow passage extending therethrough to permit fluid to pass through the cap and bypass the nozzle opening;

a turbine having a plurality of radially extending fins circumferentially positioned about the nozzle opening for directing the flow of fluid exiting the nozzle opening, the turbine being rotatable about the nozzle opening and the nozzle opening being free of any portion of the turbine; and a reverser member coupled to the turbine such that the reverser member is caused to rotate in response to rotation of the turbine, the reverser member including a cup portion having a bottom and a circumferential sidewall extending from the bottom, the reverser member positioned below the cap with an entirety of the cup portion positioned below a lowermost extent of the cap in a vertically spaced relationship to the cap and the bottom axially aligned with the flow passage to intercept the flow of fluid from the flow passage of the cap, wherein the turbine has a mounting ring from which the plurality of radially extending fins extend, wherein the spray nozzle further comprises a retaining member having a ring shape and positioned about the nozzle body and over the mounting ring of the turbine, and wherein the flow passage of the cap is sized such that a portion of the fluid flowing through the spray nozzle flows through the flow passage of the cap and contacts the inside of the cup portion causing a downward force on the turbine such that the downward force applied to the cup portion balances an upward force created by the fluid exiting the nozzle opening to cause the turbine to remain spaced from the cap and the retaining member so that a cushion of water forms between the turbine and the retaining member as the turbine rotates.

2. The spray nozzle of claim 1, wherein a rim of the cup portion has notches for diffusing fluid.

3. The spray nozzle of claim 1, wherein reverser member has a plurality of arms extending radially from the cup portion, the arms coupled to the turbine.

4. The spray nozzle of claim 3, wherein the turbine has a plurality of groups of fins, each group of fins includes the plurality of radially extending fins and the plurality of radially extending fins of each group of fins being equally spaced from one another a first distance, the groups of fins spaced apart from one another a second distance greater than the first distance.

5. The spray nozzle of claim 4, wherein the plurality of arms of the reverser member are coupled to the turbine between the groups of fins in a way that the plurality of arms are non-radially aligned with the fins of the turbine.

6. The spray nozzle of claim 1, wherein the fluid flow passage of the cap extends through a conical portion directing debris away from fluid flow passage.

7. The spray nozzle of claim 1, where the nozzle body has a circumference, and wherein the first surface is an undulating surface having four peaks substantially equally spaced about the circumference and four troughs located between the four peaks, and wherein the retaining member has four corners aligned with the four peaks of the nozzle body.

8. The spray nozzle of claim 1, wherein the first surface is an undulating surface having four peaks substantially equally spaced about the circumference and four troughs located between the four peaks, wherein the nozzle body has at least two tubular portions positioned in the fluid passage of the nozzle body, wherein the at least two tubular portions are positioned adjacent two of the four troughs, and wherein the two troughs adjacent the at least two tubular portions have a flow area different from a flow area of the other two troughs.

9. The spray nozzle of claim 8, wherein the flow area of each of the two troughs positioned adjacent the at least two tubular portions is greater than the flow area of each of the other two troughs.

10. The spray nozzle of claim 8, wherein the flow area of the two troughs positioned adjacent the two tubular portions is less than the flow area of the other two troughs.

11. The spray nozzle of claim 1, wherein the nozzle body has at least two peg portions positioned in the fluid passage of the nozzle body, wherein each of the two peg portions is positioned between two of the four troughs adjacent one of the four peaks, and wherein the peaks of the first surface positioned adjacent the peg portions have a surface area less than the surface area of the other two peaks.

* * * * *